US008910634B2

(12) United States Patent
Lu et al.

(10) Patent No.: US 8,910,634 B2
(45) Date of Patent: Dec. 16, 2014

(54) STRESS DEFORMABLE AND SEALED BREATHING MASK

(76) Inventors: Jianchun Lu, Beijing (CN); Fengyan Qu, He Bei Provence (CN); Susan X. S. Ge, Cedar Knolls, NJ (US)

( * ) Notice: Subject to any disclaimer, the term of this patent is extended or adjusted under 35 U.S.C. 154(b) by 250 days.

(21) Appl. No.: 12/819,764

(22) Filed: Jun. 21, 2010

(65) Prior Publication Data

US 2011/0308525 A1 Dec. 22, 2011

(51) Int. Cl.

| | |
|---|---|
| ***A62B 18/08*** | (2006.01) |
| ***A62B 7/10*** | (2006.01) |
| ***A62B 18/02*** | (2006.01) |
| ***A41D 13/11*** | (2006.01) |
| ***A62B 23/02*** | (2006.01) |

(52) U.S. Cl.

CPC ..... *A62B 18/025* (2013.01); *A41D 13/1115* (2013.01); *A62B 23/025* (2013.01)

USPC ..... 128/206.19; 128/206.12; 128/206.13

(58) Field of Classification Search

CPC .. A61M 16/105; A61M 16/06; A62B 18/025; A62B 23/025; A41D 13/1115

USPC ..... 128/206.12–206.14, 206.17, 206.19, 128/206.25, 206.28, 207.11; 2/9, 173–174, 2/206, 417, 424; 24/713.4, 713.6–713.8

See application file for complete search history.

(56) References Cited

U.S. PATENT DOCUMENTS

| | | | | | |
|---|---|---|---|---|---|
| 1,878,464 | A * | 9/1932 | Bulmer | 128/205.25 |
| 3,033,200 | A * | 5/1962 | Stanley | 128/206.12 |
| 3,613,678 | A * | 10/1971 | Mayhew | 128/206.19 |
| RE28,102 | E * | 8/1974 | Mayhew | 128/206.19 |
| 5,237,986 | A * | 8/1993 | Seppala et al. | 128/201.23 |
| 5,490,528 | A * | 2/1996 | Day | 132/200 |
| 5,706,803 | A | 1/1998 | Bayer | |
| 5,803,075 | A * | 9/1998 | Yavitz | 128/206.25 |
| 6,381,760 | B1 * | 5/2002 | Lampe et al. | 2/425 |
| 6,394,090 | B1 | 5/2002 | Chen et al. | |
| 7,069,930 | B2 | 7/2006 | Bostock et al. | |
| 7,421,763 | B2 * | 9/2008 | Cheng | 24/129 R |
| 8,074,660 | B2 * | 12/2011 | Duffy | 128/863 |
| 2006/0180152 | A1 | 8/2006 | Bostock et al. | |
| 2006/0201513 | A1 * | 9/2006 | Chu | 128/206.19 |
| 2009/0126064 | A1 * | 5/2009 | Reaux | 2/15 |

* cited by examiner

*Primary Examiner* — Justine Yu
*Assistant Examiner* — Douglas Sul
(74) *Attorney, Agent, or Firm* — The Patel Law Firm, P.C.; Natu J. Patel

(57) ABSTRACT

A stress deformable and sealed breathing mask that includes an air permeable rectilinear mask body having at least one layer of air filtering material and a resilient sealing strip at an upper edge of the mask body for sealing engagement with a user's face. An upper attachment strap is in a laced engagement with the mask body and the resilient sealing strip such that tightening of the upper attachment strap about a user's head causes the resilient sealing strip to resiliently deform substantially to the contour of the user's face in the bridge area of the user's nose. A lower attachment strap secures the bottom of the mask body against a portion of the user's face below the user's mouth.

19 Claims, 6 Drawing Sheets

STRESS DEFORMABLE AND SEALED BREATHING MASK

COPYRIGHT NOTICE

Portions of the disclosure of this patent application may contain material that is subject to copyright protection. The copyright owner has no objection to the facsimile reproduction by anyone of the patent application or the patent disclosure, as it appears in the Patent and Trademark Office patent file or records, but otherwise reserves all copyright rights whatsoever.

BACKGROUND OF THE INVENTION

1. Field of the Invention

The present invention relates to face masks in general and more particularly to a face mask that is stress deformable to seal the mask against a wearer's face.

2. Discussion of the Related Art

Filtering face masks are worn by individuals who desire to filter the air they breathe, either inhaled to filter out particulates in the ambient air or to filter exhaled air, such as required by medical professionals during the treatment of patients. The mask can be of a planar configuration or of a unidirectional folding configuration. Other configurations include those having shaped bodies including cup types or duck-billed types.

A planar type mask does not employ any measures to seal the mask against the wearer's face. Therefore, when worn, this type of mask leaves large gaps between the mask and the sides of the bridge of the nose of the wearer. This results in a large quantity of the unfiltered air being inhaled as entering through these gaps, thereby defeating the purpose of wearing the mask. Since the majority of the mask is in direct contact with the wearer's skin, the mask does not form a breathing space for the wearer and does not effectively filter the air.

Unidirectional folding masks also have inherent disadvantages. Although the unidirectionally folded mask can be spread out in a longitudinal direction, this configuration has its own disadvantages. A folded portion of the unidirectionally folded mask tends to cling on a sensitive portion of the wearer's face such as the tip of the wearer's nose or the wearer's lips, thus resulting in discomfort for the wearer.

Some masks, such as unidirectionally folded masks or duck-billed masks, incorporate metal wires or aluminum strips in the design. The wires and strips are adapted to function as a nose clip seal to eliminate or minimize the gap between the wearer's skin and mask in the bridge area of the wearer's nose. However, these sealing features are easily deformable and are thus easily pulled straight. Therefore, even minimal pulling forces on the mask tend to undo the seal around the bridge of the wearer's nose.

The cup type mask generally employs a hard cup type shell which cannot be folded and is therefore inconvenient to carry and is not widely accepted. Further, the cup type mask employs a wider aluminum strip to act as the nose clip seal. However, the larger aluminum strip utilized for the seal exhibits an increased rigidity such that the strip cannot be completely enjoined against the bridge of the wearer's nose to create a proper seal. To resolve this problem, the cup type mask generally uses straps having a greater pull force to keep the mask in a sealing interface with the wearer's nose by increasing the pressure applied by the mask against the wearer's face. However, prolonged wearing of this mask with increased pressure results in pain to the wearer and a deep skin indentation.

The cup type mask also has a relatively large interior cavity which, when the wearer breathes, primarily causes an exchange of air within the cavity rather than drawing air through the mask. This results in a low concentration of oxygen and increased moisture inside the mask, thereby causing the wearer to experience suffocation and a moist feeling. In some cases, the wearer can also experience cases of eczema.

Although a variable plane cavity type mask is relatively easy to use, it does have problems. Manufacturing of this mask requires forming protuberant rings on each end of the mask and at the center of a sealing strip disposed on an upper edge of the mask. While the rings are merely fabricated by a plastic molding process, a fixing strap must then be affixed in an overlapping insertion manner. This results in a relatively complicated manufacturing process for this mask with correspondingly high costs. Additionally, the two ends of the fixing strap on the bottom edge of the mask are respectively fixed in a section of the mask through which the strap passes. The ends of the fixing strap are fixed first and then the strap is packed which results in decreased manufacturing efficiency. Finally, the ends of the upper and lower fixing straps are all fixed on the sealing strip and in the upper and lower sections, so the length of the straps is not adjustable to accommodate the different sizes of heads wearing the masks.

Therefore, previous masks often offer either ease of manufacturing with a corresponding beneficially low cost, but do not seal about the user's face, or, the masks provide a desired level of sealing, but are relatively complicated to manufacture with a correspondingly undesirable high cost.

Thus what is desired is a mask that is uncomplicated and inexpensive to manufacture and yet provides sealing between the mask periphery and the user's face.

SUMMARY OF THE INVENTION

The present invention is directed to a stress deformable and sealed breathing mask. The mask includes an air permeable rectilinear mask body having at least one layer of air filtering material and a resilient sealing strip at an upper edge of the mask body for sealing engagement with a user's face. An upper attachment strap is in a laced engagement with the mask body and the resilient sealing strip such that tightening of the upper attachment strap about a user's head causes the resilient sealing strip to resiliently deform substantially to the contour of the user's face in the bridge area of the user's nose. A lower attachment strap secures a bottom of the mask body against a portion of the user's face below the user's mouth.

Another aspect of the present invention is a stress deformable and sealed breathing mask that includes an air permeable rectilinear mask body having at least one layer of air filtering material. A resilient sealing strip is located at an upper edge of the mask body for sealing engagement with a user's face. The resilient sealing strip has a central segment for resting on the bridge of the user's nose and a downwardly extending protrusion proximate to each side of the central segment for bearing against the side of the user's nose. The resilient sealing strip also defines two symmetrical curves on a lower edge thereof, each curve gradually inclined toward an upper edge of the resilient sealing strip from a respective end of the strip to an adjacent one of the downwardly extending protrusions. An upper attachment strap is in laced engagement with the mask body and the resilient sealing strip such that tightening of the upper attachment strap about a user's head causes the sealing strip to resiliently deform substantially to the contour of the user's face on the bridge area of the user's nose. A lower attachment strap secures a bottom of the mask body against a portion of the user's face below the user's mouth.

These and other features, aspects, and advantages of the invention will be further understood and appreciated by those skilled in the art by reference to the following written specification, claims and appended drawings.

BRIEF DESCRIPTION OF THE DRAWINGS

For a fuller understanding of the nature of the present invention, reference should be made to the accompanying drawings in which.

Like reference numerals refer to like parts throughout the several views of the drawings.

DETAILED DESCRIPTION OF THE PREFERRED EMBODIMENT

For purposes of the description herein, the terms "upper", "lower", "left", "rear", "right", "front", "vertical", "horizontal", and derivatives thereof shall relate to the invention as oriented in FIGS. 1 through 6. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise. Any embodiment described herein as "exemplary" is not necessarily to be construed as preferred or advantageous over other embodiments.

Figure 1:
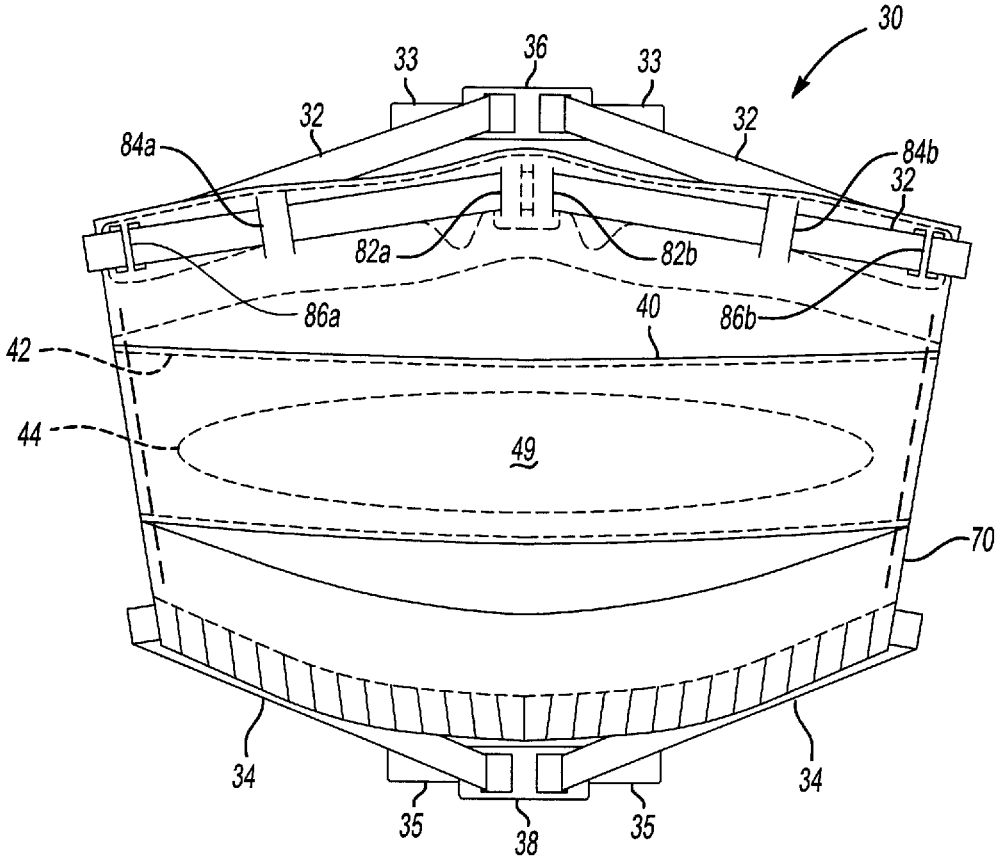
FIG. 1 is a front elevation view of a mask according to one embodiment of the present invention illustrating the mask deformations for conforming to the contours of a wearer.

FIG. 1 is a front elevation view of a stress deformable and sealed mask 30 according to one embodiment of the present invention illustrating the mask deformations for conforming to the contours of a wearer. FIG. 1 illustrates various features and components of mask 30. Mask 30 comprises a mask body 70 having a rectilinear shape with an upper attachment strap 32 proximate to an upper edge of mask body 70 and a lower attachment strap 34 proximate to a lower edge of mask body 70. Straps 32 and 34 function to extend around a user's head to secure mask 30 over the user's nose and mouth. Lower strap 34 is secured along a bottom edge of mask body 70. In one embodiment, lower strap 34 can be bonded to the bottom edge of mask body 70. In an alternative embodiment, mask body 70 can include a passageway along the bottom edge of mask body 70 through which strap 34 is inserted and passes through. Straps 32 and 34 are made of a resilient-elastic material, and can be selected from natural rubber, synthetic rubber, rubber wire which can be interwoven with silk thread, or other similar resilient-elastic materials known in the art.

In one embodiment, a set of six lace apertures 82*a*, 82*b*, 84*a*, 84*b*, 86*a*, and 86*b* are disposed along the upper edge of mask body 70. Lace apertures 86*a* and 86*b* are each disposed at a lateral edge 78 (shown in FIG. 3) of mask body 70, and a set of central lace apertures 82*a* and 82*b* are positioned at the center of mask body 70. In one embodiment, lace apertures 84*a* and 84*b* are longitudinally positioned inwardly from an edge of mask body 70 to a distance approximately equal to one-sixth to one-fourth of the width of mask body 70. Aperture 84*a* is located on the left side of mask body 70 and aperture 84*b* is located on the right side of mask body 70, at the prescribed distance of one-sixth to one-fourth of the length of mask body 70.

An overlapped layer 40 is formed in the middle part of the outer surface of mask 30. Overlapped layer 40 is formed by bi-directionally folding an upper portion of mask body 70 in the horizontal direction at a bi-directional fold 46 (shown in FIG. 4) and by also bi-directionally folding a lower portion of mask body 70 in the horizontal direction at a bi-directional fold 48 (shown in FIG. 4).

A supporting sheet 42 is provided within overlapped layer 40. The middle of supporting sheet 42 defines an elongated aperture 44 therethrough to further define a breathing area 49, which is unobstructed other than for the layered filter material of mask body 70. In one embodiment, overlapped layer 40 has a height approximately one-third to one-half the formed height of mask body 70.

Figure 2:
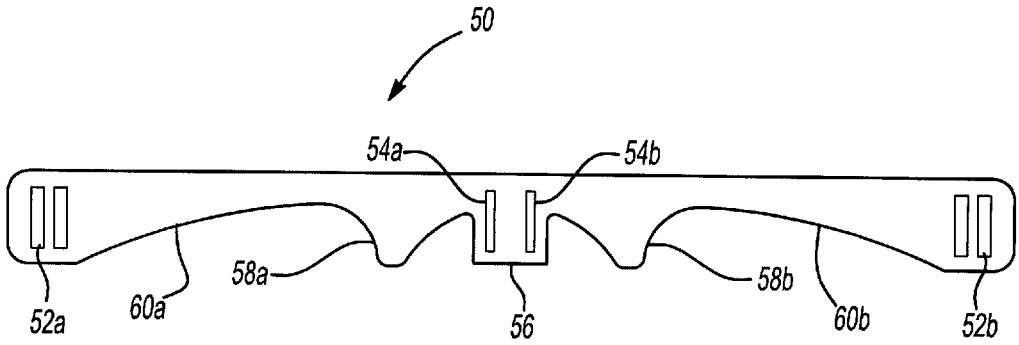
FIG. 2 is an elevation view of the resilient sealing strip for sealing the mask across the bridge area of the user's nose.

FIG. 2 is an elevation view of a resilient elongated sealing strip 50 for sealing the mask across the bridge area of the user's nose. Sealing strip 50 is formed from a resilient, flexible material. Sealing strip 50 has a center section 56 for bearing on the bridge of the user's nose. Downwardly extending protrusions 58*a* and 58*b* are positioned on both sides of and proximate to center section 56. Protrusions 58*a* and 58*b* function to bear against the sides of the bridge of the user's nose during wearing of mask 30. Two symmetrical curves 60*a* and 60*b* are formed on the lower edge of sealing strip 50. Each curve 60*a* and 60*b* gradually inclines from a respective end of sealing strip 50 toward an adjacent protrusion 58*a* and 58*b*, respectively, and also toward the upper edge of sealing strip 50. A central set of lacing apertures 54*a* and 54*b* are defined within center section 56 and a set of end lacing apertures 52*a* and 52*b* are defined at each respective end of sealing strip 50. End lacing apertures 52*a* and 52*b* correspond to apertures 86*a* and 86*b* (shown in FIG. 1), respectively, in mask body 70 (shown in FIG. 1). Similarly, center apertures 54*a* and 54*b* correspond to apertures 82*a* and 82*b* (shown in FIGS. 1 and 5) in mask body 70.

Figure 3:
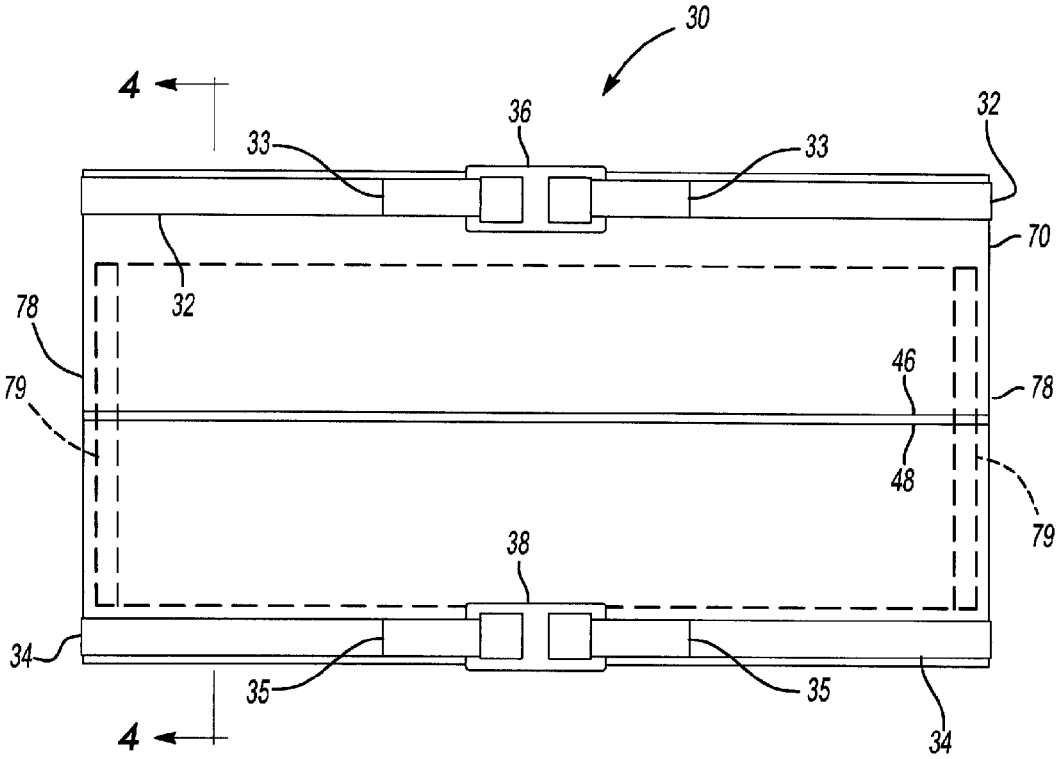
FIG. 3 is an elevation view of the back of the mask showing the surface that contacts the user's face.

FIG. 3 is an elevation view of the back of mask 30 showing the surface that contacts the user's face. A horizontal opening 47 (shown in FIG. 4) is formed along the horizontal direction at a mid-portion of an inner surface of mask body 70 by folds 46 and 48, which also form overlapped layer 40 (shown in FIG. 1). Both ends of overlapped layer 40 are fixedly connected to lateral edges 78 of mask body 70 at bond areas 79. Each of straps 32 and 34 have ends 33 and 35, respectively, that are threaded through and engaged with unidirectional adjustment clips 36 and 38.

In one embodiment, the bottom edge of mask body 70 defines a passageway along the bottom edge which is slightly wider than lower strap 34, which allows the bottom edge to naturally shrink and form many folds under friction by pulling on ends 35.

Figure 4:
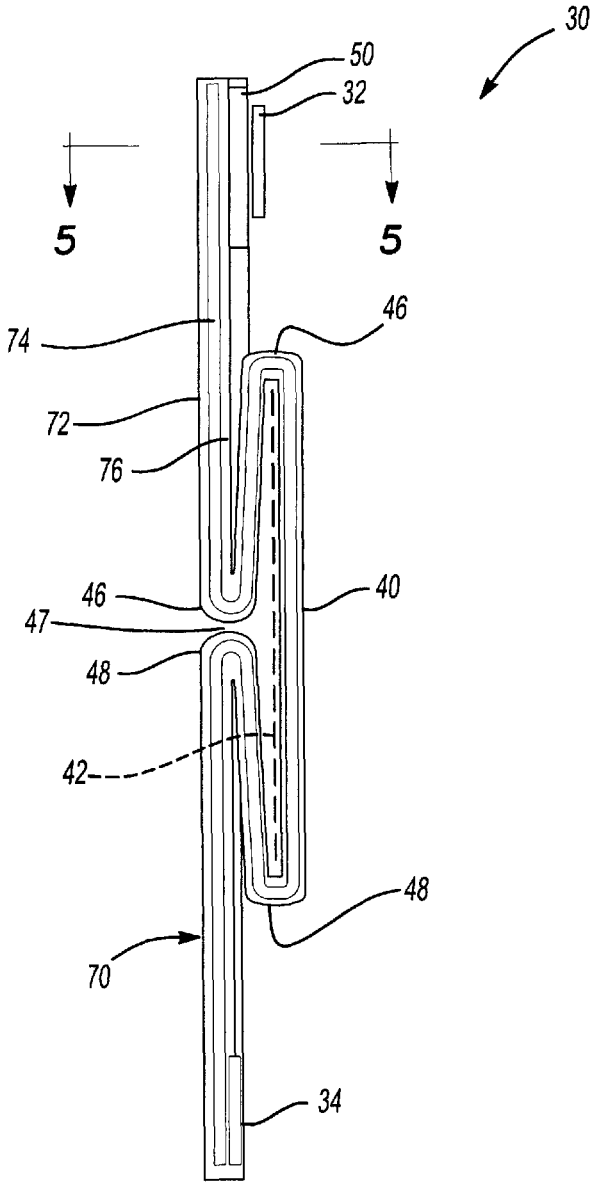
FIG. 4 is a cross section of a right elevation view of the mask shown in FIG. 3 illustrating the front fold and taken along the line 4-4 of FIG. 3.

FIG. 4 is a cross section of a right elevation view of mask 30 (reference Line 4-4 shown in FIG. 3) illustrating the front fold. As shown in FIG. 4, mask body 70 is constructed of an inner protective layer 72, a filter layer 74 and an outer protective layer 76. Filter layer 74 is one of a number of materials known in the art to filter out undesirable particulates including airborne germs and viruses while allowing the passage therethrough of air for the user to breathe. Protective layers 72 and 76 protect filter layer 74 from being damaged and thus compromising its filtering function.

Figure 5:
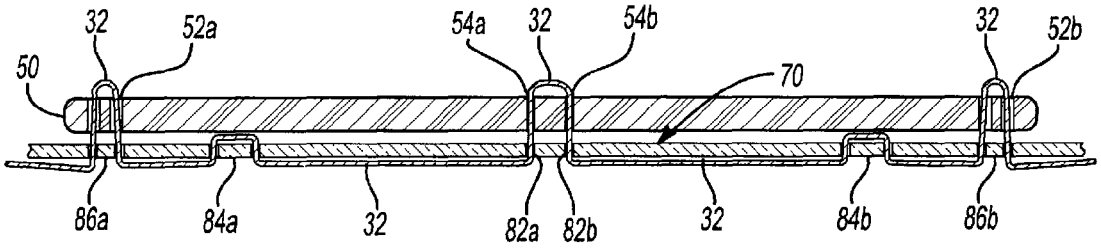
FIG. 5 is a cross section of a plan view of the upper edge of the mask shown in FIG. 4 illustrating the threading of the upper strap relative to the resilient sealing strip and taken along the line 5-5 of FIG. 4.

FIG. 5 is a cross section of a plan view of the upper edge of mask 30 (reference Line 5-5 shown in FIG. 4) illustrating the threading of upper strap 32 relative to resilient sealing strip 50. As illustrated in FIG. 5, a cross-sectional plan view of the upper portion of mask 30 shows upper strap 32 passing through the six lace apertures 82*a*, 82*b*, 84*a*, 84*b*, 86*a* and 86*b* located in mask body 70 and apertures 52*a*, 52*b*, 54*a* and 54*b* of sealing strip 50. When passing through end lace apertures 86*a* and 86*b*, and center lace apertures 82*a* and 82*b*, upper strap 32 also passes through end lace apertures 52*a* and 52*b*, and center lace apertures 54*a* and 54*b* of sealing strip 50, respectively. However, at lace apertures 84*a* and 84*b*, upper strap 32 passes through mask body 70 only. There are no apertures in sealing strip 50 corresponding to apertures 84*a* and 84*b* in mask body 70.

Figure 6:
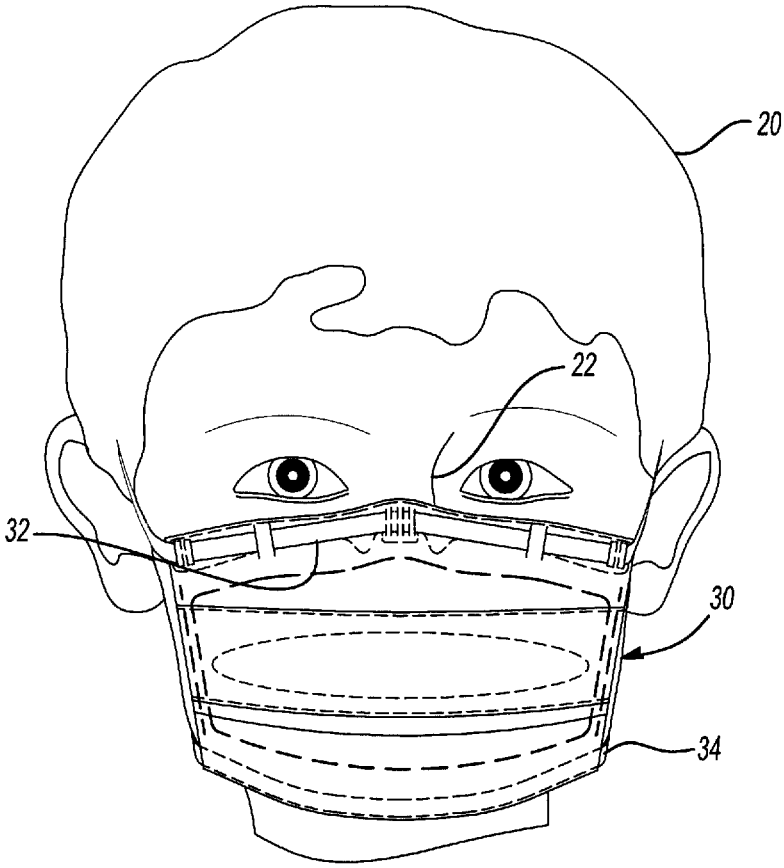
FIG. 6 is a front elevation view of a user wearing a breathing mask according to one embodiment of the present invention.

FIG. 6 illustrates mask 30 in position on a user 20 and also refers to specific features more fully illustrated and previously discussed in FIGS. 1-5. Ends 33 and 35 (shown in FIG. 1) of upper and lower straps 32 and 34 are inserted into adjustment clips 36 and 38 (shown in FIG. 1) respectively. When mask 30 is not worn, mask 30 keeps its original shape. Mask 30 is placed over the face of user 20 such that the upper edge of mask 30 with sealing strip 50 (shown in FIG. 2) is centered over a bridge 22 of the nose of user 20 with straps 32 and 34 encircling the head of user 20. Ends 33 and 35 of straps 32 and 34 are pulled until mask 30 is comfortably seated against the face of user 20. Further, adjusting the length of straps 32 and 34 by pulling them through unidirectional clips 36 and 38 permits mask 30 to be worn by users 20 having differently sized heads. This adjustability maintains the functionality and effectiveness of mask 30 regardless of the size or shape of the head of user 20.

As ends 33 of strap 32 are pulled through unidirectional adjustment clip 36, sealing strip 50 resiliently deforms to bear on the face of user 20. Center section 56 (shown in FIG. 2) and the corresponding area of mask body 70 (shown in FIG. 1) rests directly on bridge 22 of the nose of user 20 and protrusions 58*a* and 58*b* (shown in FIG. 2) bear against the sides of the user's nose. The remainder of sealing strip 50 along curved areas 60 (shown in FIG. 2) deforms to match the contour of the upper cheek area of user 20, thus providing a sealed upper edge of mask 30.

Sealing strip 50 closely bears on the face of user 20 as a function of its resilience. The tension and compaction of the resilience of upper strap 32 upon and in combination with the resilience of sealing strip 50 causes strip 50 to elastically press against the face of user 20. The natural deformation and resilience of sealing strip 50 can change according to the movement of facial muscles while maintaining the desired sealing of mask 30 against the face of user 20. Such facial movements include free breathing, deep breathing, talking, head shaking, looking up, looking down, bowing, and other similar bodily movements.

Bi-directional folds 46 and 48 (shown in FIG. 4) permit outward expansion of overlapped layer 40 (shown in FIG. 1) to cause a protuberance that approximately conforms to the various contours of the nose and mouth area of user 20. As ends 35 of lower adjusting strap 34 are pulled through adjusting clip 38, the lower edge of mask body 70 is naturally shrunk and forms many folds as a result of the friction generated by user 20 pulling on ends 35. The shrinking of the lower edge of mask body 70 facilitates the protuberance of overlapped layer 40 thereby forming a breathing cavity which does not contact the nose or mouth of user 20. Aperture 44 (shown in FIG. 1) of supporting sheet 42 (shown in FIG. 4) is positioned proximate to the nostrils and mouth of user 20, allowing user 20 to easily breathe through filtered area 49 (shown in FIG. 1). Such a protuberance of overlapped layer 40 also increases the effective filtering area by eliminating the contact to the nose and mouth and further enhances the comfort of wearing mask 30 for user 20.

While the present invention has been described in detail with regards to embodiments, it should be appreciated that various modifications and variations may be made in the present invention without departing from the scope or spirit of the invention. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

The above description is considered that of one embodiment only. Modifications of the invention will occur to those skilled in the art and to those who make or use the invention. Features illustrated or described as part of one embodiment can be used in another embodiment to provide yet another embodiment such that the features are not limited to the specific embodiments described above. Therefore, it is understood that the embodiments shown in the drawings and described above are merely for illustrative purposes and are not intended to limit the scope of the invention, which is defined by the following claims as interpreted according to the principles of patent law, including the doctrine of equivalents.

We claim:

1. A stress deformable and sealed breathing mask, the mask comprising:

an air permeable rectilinear mask body having at least one layer of air filtering material;

a resilient sealing strip configured to create a sealing engagement with a user's face at an upper edge of the mask body;

an upper attachment strap in a laced engagement with the mask body and the resilient sealing strip such that tightening of the upper attachment strap about a user's head causes the sealing engagement of the resilient sealing strip to resiliently deform substantially along the laced engagement to the contour of the user's face and in the bridge area of the user's nose, wherein the resilient sealing strip defines a first set of lacing apertures in a central segment and a second set of lacing apertures at each end thereof, and wherein the mask body defines a set of lacing apertures corresponding to each of the first and second sets of lacing apertures of the resilient sealing strip, and wherein the upper attachment strap is lacingly engaged through each of the sets of lacing apertures of the mask body and the each of the first and second sets of lacing apertures of the resilient sealing strip, and also wherein the mask body further includes a set of inwardly positioned lacing apertures from each end of the mask body at a distance of one-sixth to one-fourth of a width of the mask body, and further wherein the upper attachment strap is in laced engagement with the set of inwardly positioned lacing apertures of the mask body, wherein the sealing engagement of the resilient sealing strip has the central segment for resting on the bridge of the user's nose, and further wherein the sealing engagement of the resilient sealing strip includes a downwardly extending protrusion proximate to each side of the central segment to bear against the side of the user's nose; and a lower attachment strap for securing a bottom of the mask body against a portion of the user's face below the user's mouth.

2. The breathing mask according to claim 1 wherein the mask body comprises an outer protective layer, a central filter layer, and an inner protective layer.

3. The breathing mask according to claim 2 wherein an upper edge of the outer protective layer contains the sets of lacing apertures corresponding to each of the first and second sets of lacing apertures of the resilient sealing strip and the set of inwardly positioned lacing apertures of said the mask body.

4. The breathing mask according to claim 1 wherein the mask body includes a central horizontally extending overlapped layer formed at a mid-height area of the mask body.

5. The breathing mask according to claim 3 wherein the overlapped layer is formed by an upper bi-directional horizontal fold and a lower bi-directional horizontal fold.

6. The breathing mask according to claim 4 wherein the upper fold and the lower fold define a horizontal opening in an inner surface of the mask.

7. The breathing mask according to claim 4 wherein each end of the overlapped layer is fixedly attached to a lateral edge of the mask body.

8. The breathing mask according to claim 4 wherein a height of the overlapped area is between one-third and one-half a height of the mask body.

9. The breathing mask according to claim 4 further including a supporting sheet on an inner surface of the overlapped layer.

10. The breathing mask according to claim 8 wherein the supporting sheet defines an aperture therethrough to allow the user's breath to pass therethrough and through the overlapped layer.

11. The breathing mask according to claim 1 wherein the sealing engagement of the resilient sealing strip defines two symmetrical curves on a lower edge thereof, each curve gradually inclined toward an upper edge of the resilient sealing strip from a respective end of the resilient sealing strip toward a center of the resilient sealing strip.

12. The breathing mask according to claim 1 wherein the upper attachment strap is inserted into an adjustment clip, and also wherein the lower attachment strap is inserted into another adjustment clip.

13. A stress deformable and sealed breathing mask, the mask comprising:

an air permeable rectilinear mask body having at least one layer of air filtering material;

a resilient sealing strip configured to create a sealing engagement with a user's face at an upper edge of the mask body, the sealing engagement of the resilient sealing strip having a central segment for resting on the bridge of the user's nose and a downwardly extending protrusion proximate to each side of the central segment to bear against the side of the user's nose, and defining two symmetrical curves on a lower edge thereof, each curve gradually inclined toward an upper edge of the resilient sealing strip from a respective end of the resilient sealing strip to an adjacent downwardly extending protrusion;

an upper attachment strap in a laced engagement with the mask body and the resilient sealing strip such that tightening of the upper attachment strap about a user's head causes the central segment, the downwardly extending protrusion and the two symmetrical curves of the sealing engagement to resiliently deform substantially along the laced engagement to the contour of the user's face and in the bridge area of the user's nose, wherein the resilient sealing strip defines a first set of lacing apertures in the central segment and a second set of lacing apertures at each end thereof, and further wherein the mask body defines a set of lacing apertures corresponding to each of the first and second sets of lacing apertures in the resilient sealing strip, and also wherein the upper attachment strap is lacingly engaged through each of the sets of lacing apertures of mask body and each of the first and second sets of lacing apertures of resilient sealing strip, and wherein the mask body further includes a set of inwardly positioned lacing apertures from each end of the mask body at a distance of one-sixth to one-fourth of a width of the mask body, and further wherein the upper attachment strap is in laced engagement with the set of inwardly positioned lacing apertures of the mask body; and a lower attachment strap for securing a bottom of the mask body against a portion of the user's face below the user's mouth.

14. The breathing mask according to claim 13 wherein the mask body includes a central horizontally extending overlapped layer formed by an upper bi-directional horizontal fold and a lower bi-directional horizontal fold at a mid-height area of the mask body, the overlapped layer fixedly attached to a lateral edge of the mask body, and wherein the upper fold and the lower fold define a horizontal opening in an inner surface of the mask.

15. The breathing mask according to claim 14 wherein a height of the overlapped area is between one-third and one-half a height of the mask body and further wherein a height of the overlapped area is between one-third and one-half a height of the mask body.

16. The breathing mask according to claim 14 further including a supporting sheet on an inner surface of the overlapped layer.

17. The breathing mask according to claim 16 wherein the supporting sheet defines an aperture therethrough to allow the user's breath to pass therethrough and through the overlapped layer.

18. The breathing mask according to claim 13 wherein the mask body comprises an outer protective layer, a center filter layer, and an inner protective layer, the upper edge of the outer protective layer containing the sets of lacing apertures corresponding to each of the first and second sets of lacing apertures in the resilient sealing strip and the set of inwardly positioned lacing apertures of the mask body.

19. The breathing mask according to claim 13 wherein the upper attachment strap is inserted into an adjustment clip, and also wherein the lower attachment strap is inserted into another adjustment clip.

* * * * *